US005664310A

United States Patent [19]

Penisson

[11] Patent Number: 5,664,310

[45] Date of Patent: Sep. 9, 1997

[54] COMBINATION POWER AND BACKUP TONG SUPPORT AND METHOD

[75] Inventor: Dennis J. Penisson, Raceland, La.

[73] Assignee: Bilco Tools, Inc., Houma, La.

[21] Appl. No.: 494,160

[22] Filed: Jun. 23, 1995

[51] Int. Cl.[6] ..... B23Q 17/00

[52] U.S. Cl. ..... 29/407.02; 81/57.34; 81/57.35; 248/581; 248/603

[58] Field of Search ..... 248/581, 589, 248/591, 592, 593, 603, 605; 81/57.34, 57.35, 57.16, 57.24; 29/407.01, 407.02, 407.05, 407.09, 407.1, 456, 237, 240

[56] References Cited

U.S. PATENT DOCUMENTS

| | | | |
|---|---|---|---|
| 3,838,613 | 10/1974 | Wilms | 81/57.34 |
| 4,402,239 | 9/1983 | Mooney | 81/57.34 |
| 4,574,664 | 3/1986 | Curry | 81/57.34 |
| 4,649,777 | 3/1987 | Buck | 81/57.34 |
| 4,727,781 | 3/1988 | Yuehui et al. | 81/57.34 |
| 5,081,888 | 1/1992 | Schulze-Beckinghausen | 81/57.34 |
| 5,099,725 | 3/1992 | Bouligny, Jr. et al. | 81/57.34 |
| 5,390,568 | 2/1995 | Pietras | 81/57.16 |
| 5,409,192 | 4/1995 | Oliver | 248/581 |

FOREIGN PATENT DOCUMENTS

| | | | |
|---|---|---|---|
| 807668 | 7/1951 | Germany | 248/581 |

*Primary Examiner*—David P. Bryant
*Attorney, Agent, or Firm*—Browning Bushman

[57] ABSTRACT

A support 10 is provided for supporting both a power tong PT and a backup tong BT during makeup of a threaded connection TC between a lower oilfield tubular LT and an upper oilfield tubular UT. The support 10 includes a plurality of legs 12 and 14 each extending upwardly from the backup tong BT, a support plate 18 affixed to an upper end of the plurality of legs for engagement with the upper oilfield tubular, and a compensation member 32, 44, 60 secured to the support plate 18 for supporting the power tong PT relative to the backup tong BT while allowing vertical movement of the power tong relative to the backup tong during makeup or break out of the threaded connection.

22 Claims, 1 Drawing Sheet

COMBINATION POWER AND BACKUP TONG SUPPORT AND METHOD

FIELD OF THE INVENTION

The present invention relates to techniques and equipment for reliably making up and breaking apart threaded oilfield tubular connections. More particularly, the present invention relates to a support for interconnecting a power tong and a backup tong to reduce sideloading on torqued oilfield tubular connections and to increase the accuracy of makeup torque readings.

BACKGROUND OF THE INVENTION

Many oil field tubular connections are threaded together (makeup) and unthreaded (broken apart) using a power tong and a backup tong. The backup tong is fixed to the lower stationary joint of pipe, while the upper pipe is rotated by actuating the power tong to makeup or break apart the threaded connection. As oilfield tubular connections become more sophisticated, increased emphasis must be placed on reliably making up each seal within the connection, whether metal-to-metal or elastomeric. Over-torquing a threaded connection is also a problem, particularly when using more expensive tubulars which may include chrome or other chemically resistive coatings. An oilfield tubular connection makeup at its proper torque value is thus becoming increasingly important. Accurate makeup torque readings are frequently not obtained with prior art equipment, particularly for fiberglass or other non-ferrous tubulars which typically have a desired low makeup torque.

A backup tong may be "tied off" by connecting a cable between the tong body and any stationary member on the rig. The generally heavier power tong may be supported from a vertical cable or lifting sling, and may include a spring for raising and lowering the power tong relatively short distances. A separate cable may be used to tie off the power tong to prevent rotation of the power tong body. The power tong and backup tong thus are supported independently of each other. This arrangement allows for pivoting of the tubulars and sideloading on the connection threads, which is detrimental to reliable makeup of the connection. A makeup torque indicator may be provided in the cable which ties off the power tong, and the angle of the cable relative to the tong affects the torque measurement. Also, the torque applied to the connection cannot be easily measured due to the high sideloading caused by pipe twisting.

Another arrangement for supporting a power tong and a backup tong includes a vertical cable or lifting sling as described above with an optional spring for vertically raising and lowering the power tong short distances. The backup tong is supported by the power tong, typically from a frame which includes a plurality of legs which extend downwardly from the power tong and through apertures in the backup tong. Once activated to engage the lower pipe, the position of the lower backup tong is fixed. A plurality of leg springs may be used for allowing limited vertical movement of the power tong with respect to the fixed backup tong during makeup and breakout of the threaded connection. A rigid torque plate typically extends downwardly from the power tong and engages a load cell provided on the backup tong for measuring torque. The torque plate thus slides along the load cell as the connection is made up. This arrangement also tends to allow for misalignment and twisting of the pipe, thereby creating sideloading and inaccurate torque readings. Since the load cell is in a different vertical plane than the power tong, pipe and tong twisting results in inaccurate torque measurements.

In yet another arrangement, the backup tong is supported from the power tong with a frame as described above, and a separate tong support plate provided below the backup tong is also suspended from the power tong. As in the previously described arrangement, the backup tong is firmly fixed to the lower joint of pipe, and will not move vertically or horizontally during makeup of the threaded connection. The power tong and the support plate thus move vertically with respect to the fixed backup tong during the makeup and breakout operations. The power tong, the support plate, and the frame also move horizontally relative to the fixed backup. The combined weight of these components moving horizontally can affect the accuracy of the torque reading, particularly at low torques. The output from the load cell has questionable accuracy because the load cell is provided within the plane of the backup tong, and the power tong twists relative to the fixed backup tong. None of these designs thus overcome the problem of side and axial thread loading, and inaccurate torque readings. For each of these arrangements, pipe twisting results in thread sideloading which adversely effects the reliability of the threaded connection.

Single joint compensators have been used for installation between a tubular string and an elevator to assist in the stabbing and makeup of threaded connections for oilfield tubulars. The single joint compensator provides weight balancing and compensation, and may include an air spring with suitable lifting and stroking capability, along with an adjustable spring. Although single joint compensators have been used in some applications to minimize the galling of threads and to reduce the difficulties associated with initially stabbing the connection, these compensators have not overcome the problems discussed above with respect to horizontal and vertical sideloading on threaded oil field tubular connections, and with respect to inaccurate torque measurements.

The disadvantages of the prior art are overcome by the present invention. An improved support and method are hereinafter provided for interconnecting both a power tong and a backup tong in a manner which will improve the reliability of the threaded oilfield tubular connection by reducing sideloading and improving torque measurement reliability.

SUMMARY OF THE INVENTION

According to a suitable embodiment of the present invention, a backup tong, a support frame, and a top support plate are provided as a rigid assembly which may be supported from a lift cable. Since this rigid assembly is fixed to the lower tubular member of an oilfield tubular connection when the backup tong is activated, there is no need for a spring in the lift cable which supports this assembly. The power tong may be supported with respect to the backup tong by springs attached to the top support plate. The arrangement of the present invention allows the power tong to easily move and follow the upper pipe as it is threaded into engagement with the lower pipe. A load cell is provided within the same horizontal plane as the power tong to reduce problems associated with inaccurate torque measurements. The makeup connection is supported by the top support plate, the power tong, and a backup tong in a manner which significantly reduces or eliminates problems associated with pipe pullover and twisting.

According to the arrangement of the present invention, the power tong is supported by the backup tong, rather than having the backup tong supported from the power tong. The top support plate is provided above the power tong to prevent pipe pullover and twisting. The load cell is provided in a horizontal plane which includes the power tong to eliminate the need to move a large amount of weight before torque is accurately recorded. The power tong may be supported on springs and moves independently of the lift line, so that little force is necessary to move the power tong against the load cell.

According to the present invention, air or hydraulic cylinders may be used instead of springs to support the power tong from the backup tong. Air cylinder pressure can be accurately controlled to support the power tong as required by the particular needs of the threaded connection. The correct application of pressure to the hydraulic cylinders will lift the rotating power tong to its proper position for commencing makeup, and little effort will be required for the tong to overcome this pressure while making up the threaded connection. The frame includes parallel support legs secured to the backup tong to keep the upper support plate properly positioned with respect to the backup tong.

It is an object of the present invention to provide a frame or support for both a power tong and a backup tong which will improve the reliability of oil field tubular connections by reducing side and axial loading on the threaded connections. The present invention also has the ability to improve the accuracy of the torque readings for the threaded connection compared to prior art techniques.

It is a feature of the present invention that the support system and method may be reliably used on different size tongs which are operated to generate relatively low torques of from 200 to 500 ft. lbs. The tong and frame of the present invention are thus particularly well suited for use when making up and breaking apart connections which require low torque, such as fiberglass tubular connections. Relatively "soft" springs may be used which are ideally matched to the weight of the tong, so that little force is needed to raise or lower the power tong with respect to the fixed backup tong. It is a related feature of the present invention that the system provides for improved accuracy of torque measurements between a power tong and a backup tong. When the connection is properly assembled, there is little damaging weight on the threads.

An advantage of the present invention is that the combination power tong and backup support may replace conventional weight compensators on a drilling rig. A further advantage of the invention is that a spring need not be provided in the lift line for the tong support. Still a further advantage of the invention is that the design does not require cables to tie-off either the power tong or the backup tong.

These and further objects, features and advantages of the present invention will become apparent in the following detailed description, wherein reference is made to the figures in the accompanying drawings.

DETAILED DESCRIPTION OF THE PREFERRED EMBODIMENTS

Figure 1:
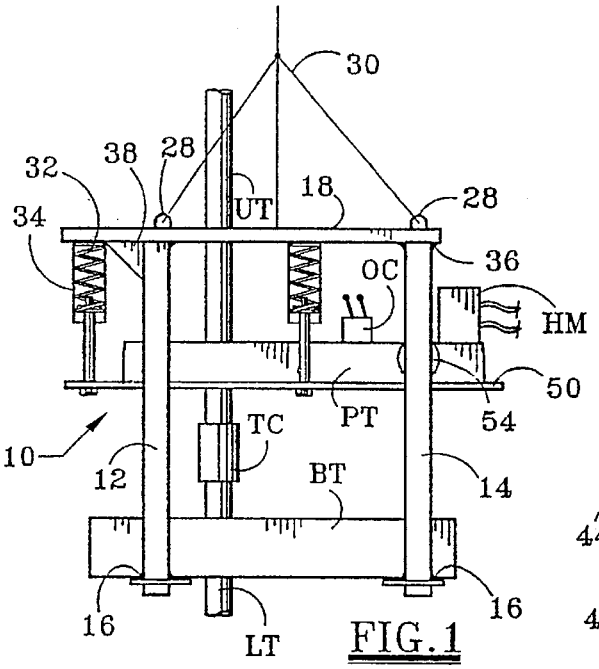
FIG. 1 illustrates a side view of a suitable support according to the present invention for supporting a backup tong from a lower pipe, and for positioning a power tong relative to the backup tong.

FIG. 1 illustrates one embodiment of the support or frame 10 according to the present invention. The support 10 is intended for positioning both a power tong PT and a backup tong BT during makeup or break out of an oilfield tubular threaded connection. The tubular member may comprise a threaded coupling TC for interconnecting a lower tubular LT and an upper tubular UT. Those skilled in the art will appreciate that the oilfield tubular may have various configurations, and may comprise lengths of elongate casing, tubing, or drill pipe with either pin and box connections or with couplings separate from the elongate tubulars. Regardless of the type of tubular, the backup tong BT is secured to the lower tubular LT during makeup and break apart of the threaded connection, and the lower tubular LT is normally stationary during this operation. In many applications, the lower tubular LT is secured in place by convention slips (not shown) which are part of the rig rotary table. The power tong PT rotates the upper tubular UT with respect to the fixed lower tubular LT during the makeup or break out operation. Various types of tongs may be used according to the present invention, although in many applications an open-throat power tong and backup tong are preferred. Each tong may be supplied with hydraulic pressure for forcing heads within each tong into biting engagement with the oil field tubular. The power tong may include a hydraulic motor HM both performing this biting function and for rotating the upper tubular with respect to the frame of the power tong. Operator controls OC are conventionally provided on each tong for controlling the operation of the tong.

Support 10 comprises a plurality of substantially vertical legs 12 and 14. A suitable embodiment of the support comprises a pair of front legs 12 and a pair of rear legs 14. Three or more legs are preferably provided to properly position and stabilize the tongs with respect to the tubulars, as explained hereafter. The support 10 also comprises a top tong support plate 18 positioned above the power tong for engaging the upper tubular UT. The lower end of each leg 12 and 14 may be fixed to the lower backup tong BT by support pad 16, and preferably the connection between each leg and the backup tong is made with a removable connection, as explained hereafter. The upper end of each leg 12 and 14 may be fixed to the tong support plate 18 by a weld 36. Support 10 and both the power tong PT and backup tong BT may be both vertically positioned and moved into and out of engagement with the oilfield tubular by a conventional cable or sling 30, which is shown attached to ears 28 projecting upwardly from the top support plate 18. Since the power tong PT moves relative to the fixed backup tong BT, a spring need not be provided in the cable 30.

The backup tong BT thus fixes the support 10 in place during makeup and break out of a threaded connection, since the backup tong in turn is secured to the lower tubular LT. During makeup or break out of a threaded connection, the power tong PT moves vertically (downward toward the backup tong during makeup and upward away from the backup tong during break out of the threaded connection). The power tong is supported from a plurality of springs 32, which each may be fixed at its upper end in a conventional manner to the support plate 18. Each spring 32 may be secured by any conventional means at its lower end directly to the power tong PT, or to plate 50 which support to power tong. If desired, each spring may be substantially enclosed within a spring canister 34. One or more gusset plates 38 may be provided for strengthening the connection between a respective vertical leg and the support plate 18. A conventional load cell 54 described subsequently may be bolted or otherwise secured to the frame of the power tong PT, and is positioned for engagement with one of the rear legs 14 of the frame 10.

Figure 3:
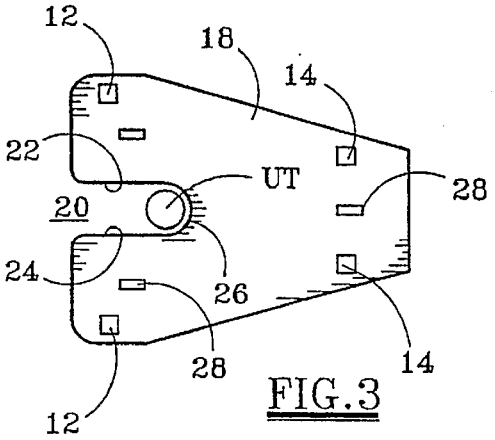
FIG. 3 is a top view of the support plate shown in FIGS. 1 and 2.

Referring briefly to FIG. 3, the top support plate 18 is shown with an open throat 20 which allows the frame 10 and both the backup tong BT and the power tong PT positioned thereon to be moved laterally on and off a tubular during the makeup and break out operations. Top support plate 18 serves a primary purpose of stabilizing the frame 10 with respect to the tubular during the makeup and break out operation, and accordingly is provided with side surfaces 22 and 24 and rear surface 26 inward of the open throat in the plate for engagement with the upper tubular UT, or for engagement with the upper tubular UT upon a relatively minor deflection of the support 10. The desired configuration of the plate 18 as shown in FIG. 3 will depend upon the configuration of the particular backup tong and power tong supported on the frame, and a representative configuration for one embodiment of a power tong and backup tong is shown in FIG. 3. FIG. 3 illustrates the pair of spaced apart front legs 12 and the rear legs 14. It is theoretically possible that the front and rear legs may pass through apertures provided in the frame of the power tong PT, although preferably the power tong PT is positioned between both the front legs 12 and the rear legs 14, and only the load cell 54 secured to the power tong PT is engagement with the legs. FIG. 3 also illustrates a suitable configuration for the upwardly projecting ear 28 for connecting the support plate 10 to the sling 30. Again, those skilled in the art will appreciate that various configurations may be provided for supporting the frame according to the present invention from a sling.

Figure 2:
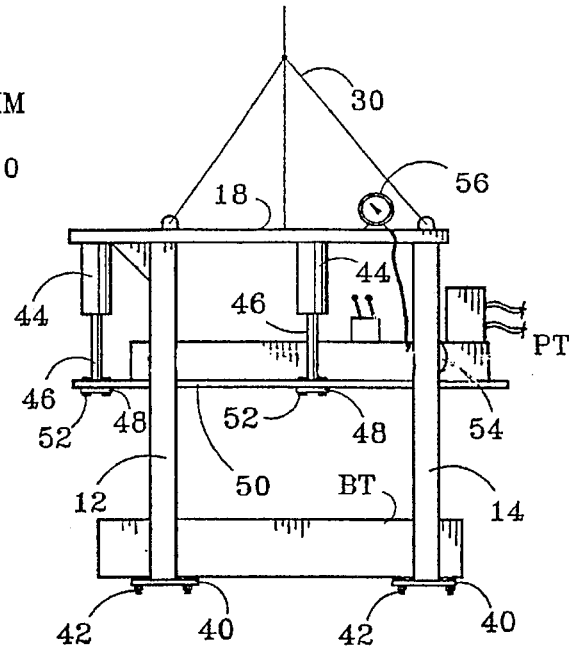
FIG. 2 illustrates an alternate embodiment of the present invention, wherein a cylinder has replaced the springs to allows for vertical movement of the power tong relative to the backup tong.

FIG. 2 discloses an alternative embodiment of the invention. For each of the various embodiments disclosed herein, the same reference numerals are used for the same or substantially similar components. Each of legs 12 and 14 is provided with a lower plate 40 affixed thereto for removably affixing the legs to both the backup tong BT and the power tong PT by conventional securing bolts 42. Legs 12 and 14 may be spaced upward from the backup tong BT as shown in FIG. 2, or alternatively may be positioned within leg holes provided within the backup tong BT. The plates 40 preferably extend between the front legs and between the rear legs, or a single plate 40 secured to all of the legs may be provided. Securing bolts 42 allow the support 10 to be removed from backup tong BT and attached to another backup tong. Similarly, the support 10 as disclosed herein may be used with various typos of power tongs PT.

The springs 34 as shown in FIG. 1 have been replaced with a plurality of hydraulic or pneumatic powered cylinders 44 each having a rod 46 with a support pad 48 affixed thereto. Each pad 48 may be provided for removably interconnecting each cylinder with a plate 50 provided below the power tong PT. The purpose of the plate 50 is merely to support the frame of the power tong PT thereon, and one or more plates 50 may be provided for suitably supporting the power tong. Hydraulic cylinders 44 and the downwardly extending rods 46 may be provided outward of the power tong PT as shown in FIG. 2, and the securing bolts 52 allow the support 10 to be used with various types of power tongs.

FIG. 2 discloses a conventional gauge 56 mounted on the support plate 18 for providing a visual indication to the operator of the torque applied between the power tong and the backup tong. Those skilled in the art will appreciate that a torque reading is output from torque cell 54, which is mounted on the power tong. According to the present invention, substantially increased accuracy of torque readings is obtained because the torque cell 54 is provided within a substantially horizontal plane that contains the frame of the power tong, and is not provided in the horizontal plane which includes the backup tong. Accordingly, twisting or bending between the power tong and the backup tong is substantially minimized by providing the combination of the frame 10 which is fixed with respect to the backup tong, by providing the upper support plate 18, and by providing the load cell 54 which is within the plane of the power tong PT.

Each of legs 12 and 14 may be formed from various structural members, such as square tubing. If the structural member does not provide a substantially planar surface for engagement with the torque cell 54, a substantially vertical torque plate (not depicted) may be secured to the rear leg 14 for engagement with the torque cell 54 to provide an accurate torque measurement. Otherwise, one of the rear legs 14 may serve as the torque plate.

Figure 4:
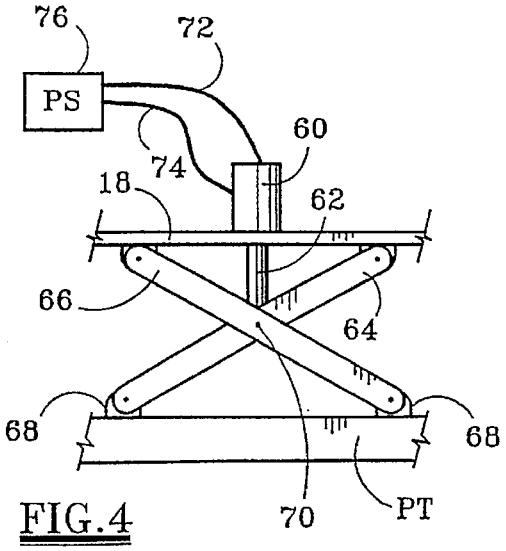
FIG. 4 illustrates a portion of yet another embodiment of the invention, wherein a cylinder and pivot mechanism allow for movement of the power tong relative to the backup tong.

FIG. 4 depicts yet another embodiment of suitable apparatus for interconnecting the top support plate 18 and the power tong PT. One or more hydraulic cylinders 60 may be provided, with each hydraulic cylinder 60 being interconnected with a suitable power source 76 by hydraulic flow lines 72 and 74. A pair of scissor legs 64 and 66 are each pivotably connected at its upper end to the support plate 18, and may be removably connected at its lower end to the power tong PT by an ear 68 adapted for slidable bolting engagement with the power tong. The scissor-legs 64 and 66 are interconnected at pivot point 70, which pivot point is also interconnected with the rod 62 extending from the cylinder 60. The arrangement as shown in FIG. 4 helps to stabilize the power tong PT in its proper position during the makeup and break out operation, and allows a single hydraulic cylinder 60 to be used for supporting the power tong PT from the frame 10.

According to the method of the present invention, a power tong and a backup tong are each supported during makeup or break out of a threaded connection between a lower oilfield tubular and an upper oilfield tubular. More particularly, the power tong PT is supported on a frame 10 which in turn is secured to the stationary backup tong. A plurality of legs are each fixedly secured to the backup tong, with each leg extending upward from the backup tong. The power tong is supported from the plurality of legs, or preferably from support plate affixed to the upper end of the plurality of legs, in a manner which allows for vertical movement of the power tong relative to the backup tong during makeup of the threaded connection. A support plate is preferably provided above the power tong as shown herein, although less desirably the support plate could be provided in between the backup tong and the power tong. During makeup or break out of the threaded connection, the support plate either engages the upper oilfield tubular, or is provided for engaging the upper oilfield tubular to limit the deflection of the frame and thus the deflection of the power tong with respect to the fixed backup tong.

The power tong may be supported with respect to the support plate from coil springs, or alternatively from a fluid-powered cylinder. The springs may be sized so that the power tong easily moves vertically with respect to the frame and the backup tong during the makeup or break out operation. Relatively "soft" springs may be used, since the springs need not also support the weight of the frame. Similarly, pressure to each fluid-powered cylinder may be easily controlled to properly position the power tong prior to the makeup operation, and to allow vertical movement of the power tong relative to the fixed frame during makeup of the threaded connection. The pivot mechanism as shown in FIG. 4 may be provided between a fluid-powered cylinder and the power tong. The load cell is preferably supported on the power tong, and one of the rear legs which is secured to the backup tong may serve as a torque plate for engaging the load cell to provide a torque measurement.

The foregoing description of the invention has been directed to a preferred embodiment in accordance with the requirements of the patent statutes and for purposes of illustration. It will become apparent, however, to those skilled in the art that many modifications and changes in the specifically described combination support and method may be made without departing from the scope and spirit of the invention. Therefore, the invention is not restricted to the preferred embodiment illustrated, and instead includes modifications which fall within the scope of the following claims.

What is claimed is:

1. An apparatus for supporting a power tong and a backup tong to makeup a threaded connection between a lower oilfield tubular and an upper oilfield tubular, the apparatus comprising:

a plurality of legs each extending upwardly from the backup tong, each leg fixed to the backup tong;

a support plate positioned vertically above the power tong and fixed to an upper end of each of the plurality of legs for engagement with the upper oilfield tubular; and a compensation member secured to the support plate for supporting the power tong relative to the backup tong while allowing vertical movement of the power tong relative to the backup tong during makeup of the threaded connection.

2. The apparatus as defined in claim 1, wherein:

the support plate includes a connection for interconnecting a lift cable to the support plate for lifting and positioning the apparatus.

3. The apparatus as defined in claim 1, wherein the compensation member comprises a plurality of a coil springs.

4. The apparatus as defined in claim 1, wherein the compensation member comprises a fluid powered cylinder.

5. The apparatus as defined in claim 4, further comprising:

a pivot mechanism movably responsive to the fluid powered cylinder for pivotably interconnecting the support plate and the power tong.

6. The apparatus as defined in claim 1, further comprising:

a load cell supported on the power tong; and torque plate fixedly secured to one of the plurality of legs for engagement with the load cell to provide a torque measurement.

7. An apparatus for supporting a power tong from a backup tong securable to a lower oilfield tubular while the power tong rotates an upper oilfield tubular, the apparatus comprising:

a plurality of legs each extending upwardly from the backup tong, each leg fixed to the backup tong;

a support plate fixed to the plurality of legs and positioned vertically above the power tong for supporting a compensation member;

a torque plate fixed to one of the plurality of legs for engagement with a load cell supported on the power tong to provide a torque measurement; and the compensation member supporting the power tong relative to the backup tong while allowing vertical movement of the power tong relative to the backup tong during makeup of the threaded connection.

8. The apparatus as defined in claim 7, further comprising:

a support plate fixed to the plurality of legs and supporting the compensation member.

9. The apparatus as defined in claim 8, wherein the support plate is positioned vertically above the power tong.

10. The apparatus as defined in claim 7, wherein:

the support plate includes a connection for interconnecting a lift cable to the support plate for lifting and positioning the apparatus.

11. The apparatus as defined in claim 7, wherein the compensation member comprises a coil spring.

12. The apparatus as defined in claim 7, wherein the compensation member comprises a fluid powered cylinder.

13. The apparatus as defined in claim 12, further comprising:

a pivot mechanism movably responsive to the fluid powered cylinder for pivotably interconnecting the support plate and the power tong.

14. The apparatus as defined in claim 7, further comprising:

a plurality of securing members for removably connecting the backup tong and the corresponding plurality of legs.

15. The apparatus as defined in claim 7, wherein the compensation member comprises a plurality of compensation members each supporting the power tong while allowing vertical movement of the power tong relative to the backup tong during makeup of the threaded connection.

16. The apparatus as defined in claim 7, wherein the support plate is configured to engage the upper oilfield tubular to maintain alignment of the upper oilfield tubular with respect to the lower oilfield tubular.

17. A method of supporting a power tong from a backup tong during makeup of a threaded connection between a lower oilfield tubular and an upper oilfield tubular, the method comprising:

fixedly securing a plurality of legs to the backup tong, each leg extending upward from the backup tong;

fixing a support plate to the plurality of legs at a position vertically above the power tong; and supporting the power tong from the support plate while allowing vertical movement of the power tong relative to the backup tong during makeup of the threaded connection.

18. The method as defined in claim 17, further comprising:

engaging the support plate with the upper oilfield tubular.

19. The method as defined in claim 17, wherein supporting the power tong comprises:

providing a coil spring for supporting the power tong.

20. The method as defined in claim 17, wherein supporting the power tong comprises:

providing a fluid powered cylinder for supporting the power tong.

21. The method as defined in claim 17, further comprising:

supporting a load cell on the power tong; and securing a torque plate to one of the plurality of legs for engagement with the load cell to provide a torque measurement.

22. The method as defined in claim 17, further comprising:

suspending the backup tong and the power tong from the support plate.

* * * * *